US006241694B1

(12) United States Patent
Goulding-Thompson et al.

(10) Patent No.: US 6,241,694 B1
(45) Date of Patent: Jun. 5, 2001

(54) TRIANGULAR HAND MASSAGER

(76) Inventors: Bonnie L. Goulding-Thompson; Michael Thompson, both of 1219 N. Wahsatch St., Colorado Springs, CO (US) 80903

( * ) Notice: Subject to any disclaimer, the term of this patent is extended or adjusted under 35 U.S.C. 154(b) by 0 days.

(21) Appl. No.: 08/627,991

(22) Filed: Apr. 8, 1996

(51) Int. Cl.[7] ..... A61H 7/00
(52) U.S. Cl. ..... 601/135; 601/134; 606/204
(58) Field of Search ..... 601/134, 135, 601/136, 137; D24/211, 214

(56) References Cited

U.S. PATENT DOCUMENTS

| | | | | |
|---|---|---|---|---|
| D. 346,449 | * | 4/1994 | Cheng | D24/214 |
| D. 372,313 | * | 7/1996 | McMillan et al. | D24/211 |
| D. 375,166 | * | 10/1996 | Goulding-Thompson et al. | D24/211 |
| 1,692,233 | * | 11/1928 | Van Patten | D21/208 |
| 3,060,928 | * | 1/1962 | Lowe | D24/211 |
| 4,483,328 | * | 11/1984 | Wolocko | 601/135 |
| 5,195,510 | * | 3/1993 | Svacina | 601/135 |
| 5,382,222 | * | 1/1995 | Yih-Jong | 601/135 |
| 5,624,385 | * | 4/1997 | Hwang | 601/135 |

* cited by examiner

*Primary Examiner*—Michael A. Brown
*Assistant Examiner*—Benjamin K. Koo
(74) *Attorney, Agent, or Firm*—G. F. Gallinger

(57) ABSTRACT

An aesthetic and highly functional massage tool is disclosed which comprises a generally triangular frame adapted to be held in the palm of one hand. It has three leg members, each leg member extending generally from a bottom side corner portion of the frame a height generally exceeding the thickness of a finger. Each leg having a generally rounded bottom portion. The legs and triangular frame are monolithically molded from plastic. The frame has a generally triangular opening so that one may extend their fingers therethrough and around a side portion of the frame. This triangular design enables one to securely and comfortably hold the massage tool in multiple positions while during use. This is important because use in any one position tires particular muscles of the massageur. It also facilitates massaging different body portions in differing manners. The triangular void facilitates wrapping one's fingers around the massage tool. It enables one to slide the tool along while pushing downwardly on it. One's hand effortlessly falls within the triangular void and over the exterior of the triangular frame sufficiently to prevent the tool from slipping out from beneath one's hand. The triangular void also allows one to massage holding the tool in an upright position. In the most preferred embodiment the generally triangular frame has the shape of a heart and the plastic is marbled in more than one color.

14 Claims, 1 Drawing Sheet

TRIANGULAR HAND MASSAGER

FIELD OF THE INVENTION

This invention relates to hand massage tools which are motivated wholly by the massager. More particularly this invention relates to such tools which are ergonomically designed so that they may be easily held and used to massage with minimal muscle fatigue.

BACKGROUND OF THE INVENTION

U.S. Pat. No. Design 346, 4491 is for a rectangular massager having a planar hand held portion with four corner massaging legs, each leg having a flat bottom side portion. The problem with this massager is that it is tiresome to hold on to. Additionally it tends to distribute pressure disproportionately on the massaging legs; those legs under the heel of the hand receive the majority of the pressure. Another problem with this massager is that the massaging legs have flat bottom side portions. The problem with this is that the corner or arris of the bottom side portion of the leg tends to bite into the body when the massager is pushed therealong.

OBJECTS AND STATEMENT OF THE INVENTION

It is an object of this invention to disclose a massage tool which is both aesthetic and highly functional. It is an object of this invention to disclose a massage tool which is easily and firmly held with minimal effort. It is yet an additional object of this invention to disclose a massage tool which may be held in many different positions so that when a massageurs muscles become fatigued in one position, he may alternate to another position. It is a final another object of this invention to disclose a massage tool which is adapted for massaging different areas of the body in a variety of ways.

One aspect of this invention provides for a massage tool comprising: a generally triangular frame adapted to be held in a hand, said frame having a generally triangular central opening so that one may extend their fingers therethrough and around a side portion of the frame; and, three spaced leg members, each leg member extending downwardly from a corner portion of the frame, and having a generally rounded bottom portion.

A preferred aspect of this invention provides for a massage tool as above wherein said triangular frame has a central void generally triangular in shape, said triangular void extending wholly therethrough and being sufficiently large to accommodate insertion of fingers along a side thereof.

Various other objects, advantages and features of novelty which characterize this invention, are pointed out with particularity in the claims annexed to, and forming part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description make reference to the annexed drawings wherein.

Figure 1:
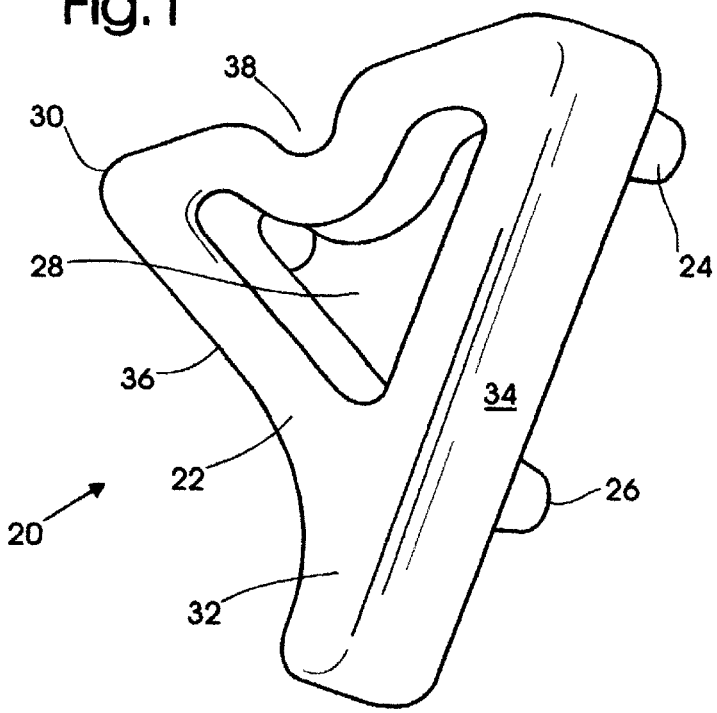
FIG. 1 is a perspective view of the triangular massage tool as viewed from the top and right.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
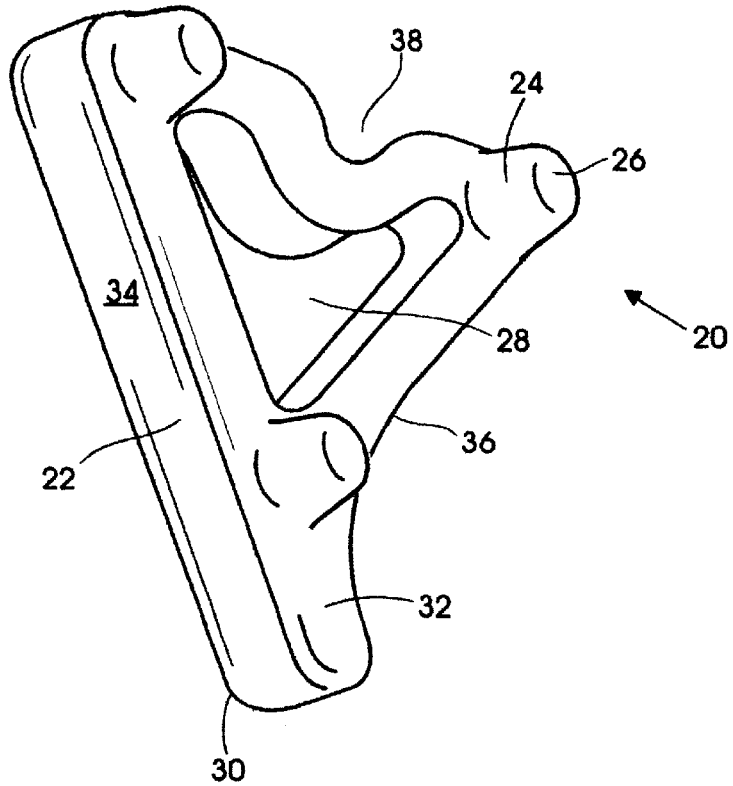
FIG. 2 is a perspective view of the triangular massage tool shown in FIG. 1 as viewed from the bottom and right.

Turning now to the drawings and more particularly to FIG. 1 we have a perspective view of a triangular massage tool 20 as viewed from the top and right. FIG. 2 is a perspective view of the triangular massage tool 20 shown in FIG. 1 as viewed from the bottom and right. The triangular massage tool 20 comprises a generally triangular frame 22 adapted to be held in the palm of one hand; and three leg members 24. The triangular frame 22 has a uniform height thereacross; most preferably this height is generally 17/16 inches. Each leg member 24 extends generally from a bottom side corner portion of the frame 22; each leg generally exceeds the thickness of a finger in height; and each leg has a generally rounded bottom portion 26.

Most preferably the legs 24 are generally circular in cross section and the rounded bottom portion 26 is generally semi-spherical. A generally semi-spherical bottom leg portion 26 was found to be far more satisfactory for massaging, than a leg 24 having a flat bottom portion with an arris therearound which could bite into the body when the massage tool 20 was pushed therealong. The legs 24 and triangular frame 22 are monolithically molded from rigid plastic which most preferably is marbled in more than one color for aesthetic appearance. The triangular frame 22 has a central opening 28 generally triangular in shape. The triangular void 28 is sufficiently large to accommodate insertion of fingers along a side thereof. The triangular frame 22 has rounded corners 30 both on its exterior and interior top and bottom side portions.

One corner portion 32 of the triangular frame 22 is elongated, said exterior corner thereof adapted for massaging when the triangular frame 22 is held in an upright position. The corner portions and more particularly the elongated corner portion 32 are particularly well suited to giving a deep probing massage of sore muscles. The elongated corner portion 32 is also particularly useful for massaging the soles of the feet with their many nerve endings. One exterior side 34 of the triangular frame 22 adjacent to the elongated corner portion 32 is straight and the other adjacent exterior side 36 of the triangular frame 22 adjacent to the elongated corner portion 32 is concave. This concave exterior side 36 is particularly useful for massaging the neck and shoulders.

One exterior side of the triangular frame 22, most preferably the exterior side of the triangular frame 22 which is opposite the elongated corner portion 32 thereof, has an inward indentation 38 in its central portion, said indentation 38 being rounded and having an interior width generally equal to the width of a finger. This indentation 38 also extends inwardly an amount generally equal to the thickness of a finger. This indentation 38 not only facilitates securely holding the triangular frame 22 with minimal effort; but additionally, when positioned over the spine, when the triangular frame 22 is held in an upright position, allows massage of the body and nerve endings along and adjacent to the spine. The interior triangular void 28 has corners adjacent to the indented side of the triangular frame 22 which are generally sufficient in width to allow the insertion of a finger therein for holding. When the exterior side of the triangular frame 22 which is opposite the elongated corner portion 32 thereof is indented, then a more pleasing aesthetic appearance is created. The massage tool 20 assumes the general shape of a heart.

The triangular design of the massage tool 20 enables one to securely and comfortably hold the massage tool in multiple positions during use. This is important because use in any one position tires particular muscles of the massageur. The massage tool 20 also facilitates massaging different body portions in differing manners. The triangular void 38 facilitates wrapping one's fingers around the massage tool 20. It enables one to slide the massage tool 20 along while pushing downwardly on it. One's hand effortlessly falls within the triangular void 38 and over the exterior of the triangular frame 22 sufficiently to prevent the tool from 20 slipping out from beneath one's hand. The triangular void 38 also allows one to massage holding the tool in an upright position.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly and operation, which are deemed readily apparent and obvious to one skilled in the art. All equivalent relationships to those illustrated in the drawings, and described in the specification, are intended to be encompassed in this invention. What is desired to be protected is defined by the following claims.

What is claimed is:

1. A massage tool comprising:

a generally horizontal triangular frame adapted to be held in a hand, said frame having a generally triangular central opening so that one may extend their fingers therethrough and around a side portion of the frame;

three spaced leg members, each leg member extending downwardly from a corner portion of the frame, and each leg member having a generally rounded bottom portion; and, wherein one exterior side of the triangular frame has an indentation in its central portion, said indentation being rounded and having an interior width exceeding one half inch to facilitate secure holding of the triangular frame with minimal effort.

2. A massage tool as in claim 1 wherein said legs and triangular frame are molded from plastic.

3. A massage tool as in claim 1 wherein one corner portion is elongated outwardly, and significantly beyond the frame for rubbing with.

4. A massage tool as in claim 3 wherein one exterior side of the triangular frame extending to the elongated corner portion is generally straight and the other adjacent exterior side of the triangular frame extending to the elongated corner portion is arched inwardly towards the central void.

5. A massage tool as in claim 1 wherein said indentation extends inwardly an amount generally equal to the thickness of a finger.

6. A massage tool as in claim 5 wherein the indentation is positioned on the exterior side of the triangular frame which is opposite the elongated corner portion thereof so that the triangular frame have the general shape of a heart.

7. A massage tool as in claim 6 wherein the interior triangular void has corners adjacent to the indented side of the triangular frame which are generally sufficient in width to allow the insertion of a finger therein.

8. A massage tool as in claim 1 said massage tool is made from a rigid marbled plastic to improve aesthetic appearance thereof.

9. A massage tool as in claim 8 wherein said triangular frame has a uniform height thereacross.

10. A massage tool as in claim 9 wherein said triangular frame has a height of between ⅝ and 1 ¼ inches.

11. A massage tool as in claim 10 wherein said height is between ¾ and 1 ⅛ inches.

12. A massage tool as in claim 11 wherein said height is generally 17/16 inches.

13. A massage tool as in claim 1 wherein said legs are generally circular in cross section and have a generally semi-spherical bottom portion.

14. A massage tool comprising:

a generally horizontal triangular frame adapted to be held in a hand, said frame having a generally triangular central opening so that one may extend their fingers therethrough and around a side portion of the frame;

three spaced leg members, each leg member extending downwardly from a corner portion of the frame, and each leg member having a generally rounded bottom portion;

wherein one corner portion of the triangular frame is elongated outwardly, and significantly beyond the frame for rubbing therewith.

* * * * *